United States Patent [19]

Roeser

[11] 4,308,434

[45] Dec. 29, 1981

[54] MULTIPOSITION ELECTRICAL SWITCH

[75] Inventor: John O. Roeser, Arlington Heights, Ill.

[73] Assignee: Otto Engineering, Inc., Carpentersville, Ill.

[21] Appl. No.: 144,360

[22] Filed: Apr. 28, 1980

[51] Int. Cl.[3] ..... H01H 19/00

[52] U.S. Cl. ..... 200/6 R; 200/6 A; 200/153 K

[58] Field of Search ..... 200/153 K, 6 R, 6 A, 200/6 B, 6 BA, 6 BB, 6 C

[56] References Cited

U.S. PATENT DOCUMENTS 3,198,892 8/1965 Barcus et al. ..... 200/6 R 4,029,915 6/1977 Ojima ..... 200/340 X

*Primary Examiner*—J. V. Truhe

*Assistant Examiner*—Morris Ginsburg

[57] ABSTRACT

A compact nonsnap switch has an actuator moveable in arcuate paths from center off to actuated positions on a shaft which pivots about first shaft shoulders on outwardly discrete casing shoulders. The shaft has second pivot shoulders located in the same diametric plane as the casing shoulders for cooperation with an elongated movable contact member which is normally biased in columnar alignment with the shaft by a coil spring. Fixed contact members are aligned below the casing shoulders for contact by the end of the movable contact member.

The coil spring also biases the first shaft shoulders against the casing shoulders through the movable contact member and allows double hinge action to take place whereby the movable contact member will normally pivot with the shaft until the lower end contacts a fixed contact causing the movable contact member to separately pivot on both the actuator shaft and the fixed contact to produce a wiping contact engagement and noncolumnar alignment of the shaft and movable contact member. An abutment means on the casing is engagable by the movable contact member in any of the actuated modes whereby accidental pivotal movement of the actuator upon casing overtravel stop surfaces prevents the movable contact member from breaking contact with a fixed contact. A flexible seal between the shaft and casing permits complex movement of the shaft. The geometry permits small travel rapid actuation by the thumb under high "G" forces and stability to transient high shock conditions.

19 Claims, 31 Drawing Figures

MULTIPOSITION ELECTRICAL SWITCH

BACKGROUND AND SUMMARY

This invention relates to electrical switches, and more particularly, to a precision, multiposition, non snap acting, human digit operated switch.

Moving boats, off road vehicles, helicopters, airplanes, etc. encounter sudden and sometimes unexpected "G"forces when in operation. Human operators of these moving devices may be called upon to perform electrical switching control operations during encounter with these "G"forces in addition to operations during normal "G"force conditions. The switches for these switching operations are often associated with a manual grip mechanism which provides multiple control functions with switch actuation occuring simultaneously with other control operations such as movement of the entire grip in a steering operation for a vehicle or boat or a joystick for an airplane.

Thumb or finger operated snap acting switches have usually been heretofore used in such applications for their known good electrical characteristics in positive switching. However, in addition to being physically larger, the heretofore used snap switches, to impart needed contact pressures and other required characteristics have other undesirable characteristics. The normal "snap action"operation of these switches requires changing input forces and/or sudden releases of forces, both often in the range of two to five pounds usually associated with some overcentering mechanism and internal spring, the input forces being provided by the thumb or finger and the reaction to these forces being taken up either in the grip, or in the operating thumb or finger, or both. When operated during a sudden or unexpected high "G"force environment, say 8 to 50 "Gs", these input and release forces can be greatly magnified. This may make actuating movement difficult or the sudden absence of needed input force at trip-point can sometimes cause unwanted movement of the grip mechanism by the operator, etc. Since the high "G"force encounters usually occur at dangerous times when control by the operator is ofen critical and precise controlled switch actuation by the operator is most needed, it can be seen that the elimination of the changing force characteristics involved in snap action switches is advantageous.

It is important that the switches be very stable and not self actuate from an "off"to an "on"position (or vice versa) when an aircraft, boat or vehicle is subjected to sudden shock that may produce transitory "G"force on the order of 50 "Gs". Thus the elimination of snap force characteristics can not be at sacrifice of stability under shock conditions or precision.

Further as vehicles and planes become more sophisticated, more and more control features are often packed into control grips whereby space is at a premium. Thus there is considerable need and demand for a more compact precision switch which may be successively actuated into a number of different positions. However, because human and vehicular safety may often be at stake, the compactness can not be obtained at the sacrifice of ruggedness, long actuating life, repeatable precision, stability under shock conditions, good electrical characteristics and good "feel".

The invention provides a non snap action, multiposition, rugged, sealed switch which is compact yet precise. Very small actuator travel and low actuation force is required to cause actuation of the movable contact from center off to engagement with various fixed contacts. The geometry of the movable parts of the switch translates the low travel movement into good movement of the movable contact toward, high unit pressure with, and wiping engagement with the fixed contact. This may be accomplished with very low input actuation force (typically in the vicinity of 16 oz.) and is easily supplied in all modes of actuation by a human thumb or finger.

The actuator is pivotally mounted on an internal array of switch casing pivot surfaces located in predetermined relation to mode locator slots formed above the pivot surfaces. The actuator is formed with a separate set of pivot surfaces for receiving the movable contact member which initially pivots from the center off position with the actuator member. After generally radial movement to engagement of the movable contact member with a fixed contact, and upon further movement of the actuator toward overtravel stop position, the movable contact pivots on the separate set of pivot surfaces on the actuator and on the fixed contact while maintaining solid wiping contact engagement. The configuration of the parts now introduces a general change in the direction of the movement of the movable contact which moves downwardly into engagement with an abutment means formed in the switch casing while maintaining engagement with the fixed contact. The abutment means has surfaces which constrains movement of the movable contact away from the fixed contact under certain conditions. The overtravel stop function is provided by side surfaces in the central switch opening which are engageable by the actuator. When the actuator is in full overtravel stop position, the actuator is pivotal about an additional point, namely the stop surface, and small movement of the actuator about this new additional pivot point could undesirably break electrical contact between the movable contact member and the fixed contact but for the abutment means in the switch casing.

The switch casing pivot surfaces and the separate actuator pivot surfaces for a four position "on"center "off"switch embodiment (but not other embodiments) may be formed in aligned square arrays along with square arrays of complimentary coacting parts on the actuator and on the contact member so that pivotal action about one side of switch casing pivot surfaces causes pivotal action about the opposite side of the square on the separate actuator surfaces. All embodiments provide precision double hinge like action in all modes while maintaining easy assembly orientation with each other and with the mode locator slots formed in the top of the casing.

A single biasing spring is required, one end engaging the movable contact member, the other the switch casing, to serve the multiple functions of returning all parts to center off position, maintain the movable contact member against the separate pivot means on the actuator, maintain the actuator in operable relation to the switch casing pivot surfaces, overpower inertial movement of the moving parts under conditions of shock and sudden high "G"forces, help impart repeatable precision movements, and in relatively low amperage usages, be a part of the common terminal path so as to reduce cost and aid in assembly operations. A flexible seal which permits complex movement of the actuator is provided so that dust and other contaminants can be kept from the moving parts.

The switch, while providing many varied good electrical and mechanical characteristics and functions in very small size, has long actuation life, is relatively easily made and assembled and has few parts.

DESCRIPTION OF THE DRAWING

The invention will be explained in conjunction with illustrative embodiments shown in the accompanying drawings, in which.

DESCRIPTION OF SPECIFIC EMBODIMENT

Figure 3:
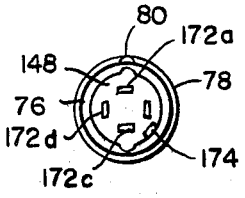
FIG. 3 is an end view of the bottom of the switch shown in FIG. 2.
Figure 2:
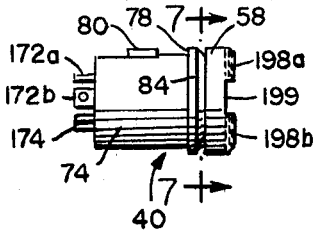
FIG. 2 is a side elevational view of the switch shown in FIG. 1.
Figure 1:
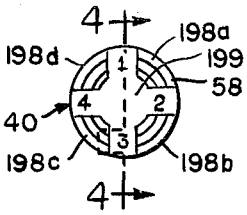
FIG. 1 is an end view of the top of a multiposition non snap switch formed in accordance with the invention which may be commercially made in the small overall approximate size shown in FIGS. 1, 2 and 3.

Referring first to FIGS. 1, 2 and 3, the multiposition compact rugged electrical switch 40 is shown in approximate full size of one commercial embodiment. The switch 40 is a center "off", four actuated positions "on"-'type, the actuator positions corresponding to the tilting of an actuator button 58 by engagement therewith by a thumb or finger to produce tilting motion at periphery adjacent the Nos. 1, 2, 3, 4, shown in FIG. 1.

As shown in greatly enlarged diagrammatic form in FIGS. 27 through 30, the switch 40 is elegantly simple in operating concept. Notwithstanding the small size and simple mechanical concepts the switch is very sophisticated in mechanical and electrical function and performance and very ruggedly constructed. In the diagrammatic form, and described in general terms to aid in understanding the details, it is seen that a switch casing means 42 has a longitudinal axis 44 and first pivot means 46 for pivotal coaction with actuator means 48 about Pt. A. The lower portion of actuator means 48 is formed with separate pivot means 50 for coaction with the top of a movable contact means 54 after it engages a fixed contact means 52 at Pt. B. The top of the movable contact means 54 then is pivotable about Pt. C at the separate pivot means 50 and the lower end of the movable contact means wipes downwardly along fixed contact means 52. This causes the lower end of the movable contact means to be trapped by the abutment means 156 formed in the bottom of the switch casing means 42 preventing accidental disengagement if pivotal action occurs at Pt. D. It is to be noted that the biasing means 56 (shown in FIG. 4) is necessary to the switch, but is not shown in the diagrammatic figures for clarity purposes.

Figure 4:
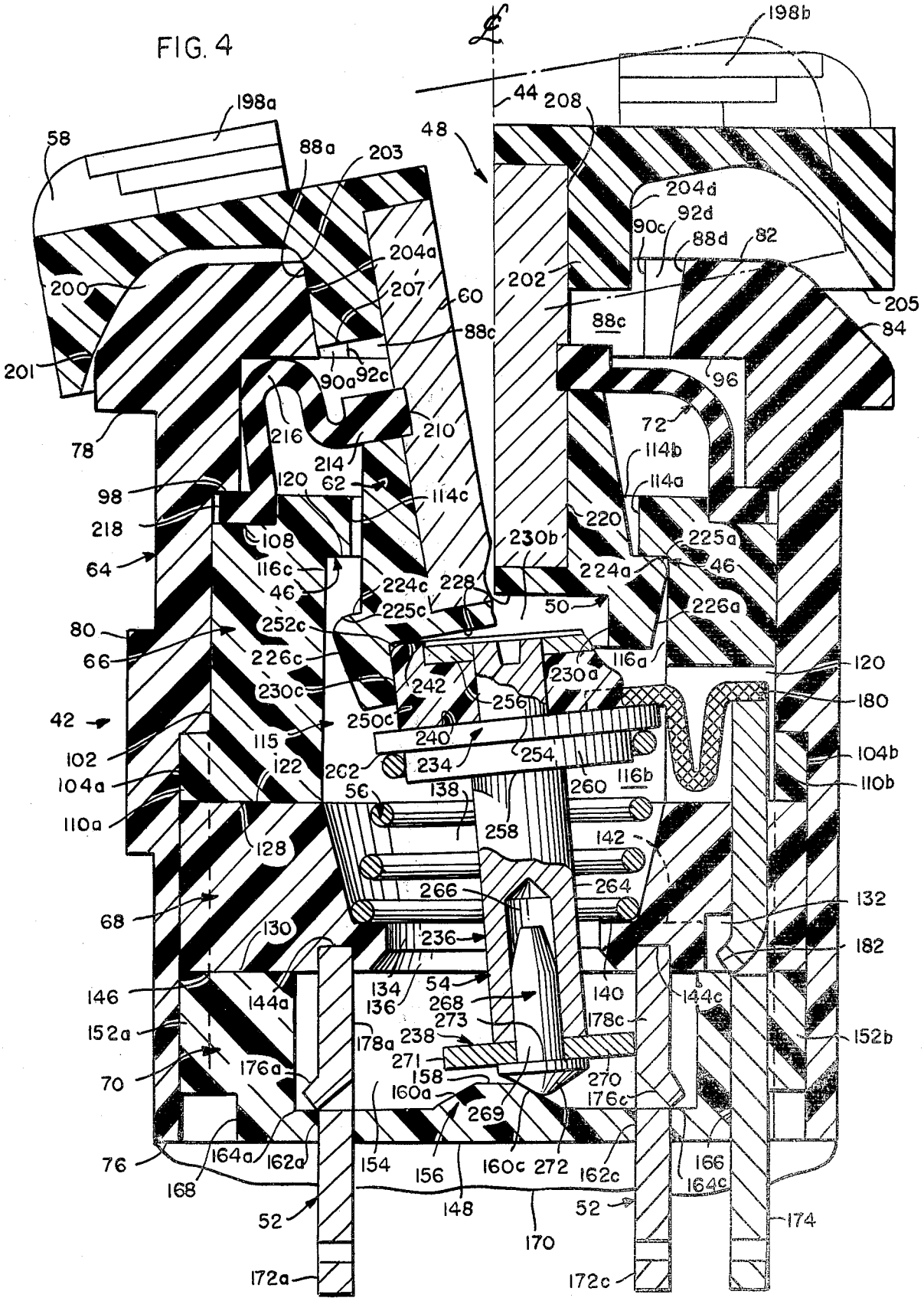
FIG. 4 is a sectional elevational view, greatly enlarged, of an embodiment using a common terminal for higher amperages, with portions in fragmentary section, 90° rotated along lines 4—4 of FIG. 1 with the right hand upper portions, except for the phantom lines, shown in the nonactuated position and the left hand and lower portions shown in an actuated position, some of the lines of the contact cut out slots (shown in FIG. 24) not being shown for purposes of not obscuring other detail.
Figure 13:
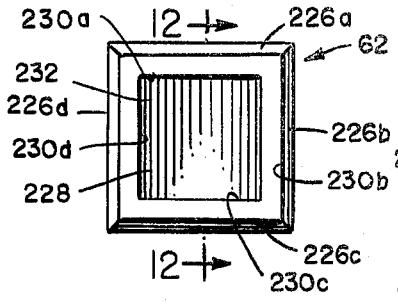
FIG. 13 is a side elevational end view of the actuator portion shown in FIGS. 12 and 14.
Figure 12:
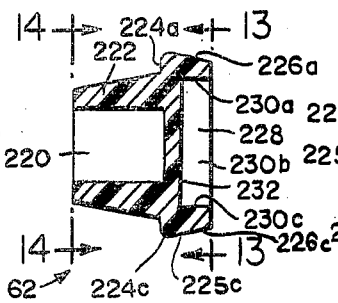
FIG. 12 is a sectional view along lines 12—12 of FIG. 13 of the bottom internal portion of the actuator rotated 90° from the position shown in FIG. 4 and which is shown isolated from the shaft of FIGS. 8 and 9 and in approximate double scale to the shaft to show details of construction.
Figure 14:
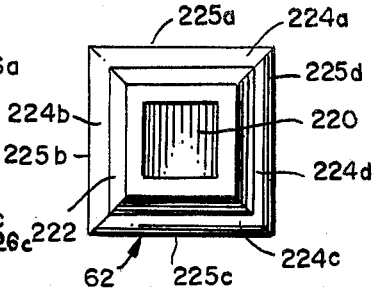
FIG. 14 is a side elevational end view of the opposite end of the actuator portion shown in FIG. 13.

Now to a very specific description, and as shown in assembled array in section in FIG. 4, the actuator means 48 comprises an exterior button 58, an actuator shaft 60 and an actuator rocker means 62. The actuator means 48 is mounted for relative movement to the switch casing means 42. The switch casing means 42 comprises the outer switch casing means 64, upper casing insert means 66, middle casing insert 68, and bottom casing insert means 70 all of which are fixedly assembled together in rigid relationship by any suitable means to form a unitary body. Each of the switch casing means 42 components 64, 66, 68 and 70 are preferably made of a hard mouldable dielectric material. A flexible sealing means 72, to be described in detail later, is sealingly attached to the shaft 60 of actuator means 48 and to the switch casing means 42 to prevent contamination of the electrical contact areas.

Figure 5:
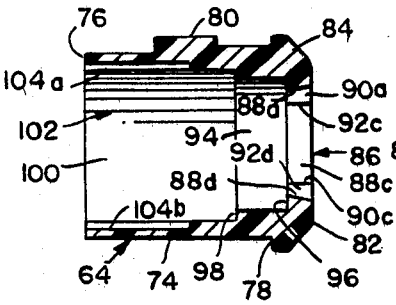
FIG. 5 is an isolated sectional view of the outer switch casing alone, enlarged approximately double to size shown in FIG. 2 taken along lines 5—5 of FIG. 6.
Figure 6:
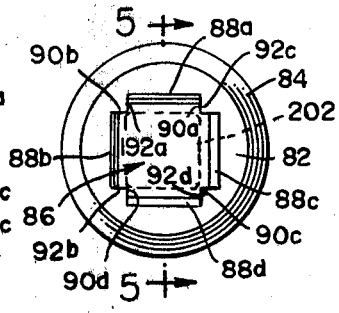
FIG. 6 is an enlarged top end view of the switch casing disassociated with the other parts to show detail of construction, with the hub of the coacting actuator button of FIG. 7 being shown in dash lines to show relative size relationships.

Returning to the outer casing means 64 shown in isolation and in section FIG. 5, in full end view in FIG. 6 and in sectional assembled relation in FIG. 4, it comprises a cylindrical casing body 74 having a bottom end portion 76 and an enlarged circumferential shoulder 78 for mounting on a suitable control device such as a steering wheel or a joystick or the like. An exterior boss 80 aligned with the axis of the body 74 may be molded on body 74 for location in mounting as will be well understood. The top 82 of body 74 is relatively thick and its outer surface joins shoulder 78 with rounded bevel outer surface 84 which affords clearance for movement of actuator button 58 as will become apparent.

Centrally located in top 82 of outer casing means 64 is a generally condensed definitively cruciform opening 86 which coacts with the actuator button 58. As will be observed the opening 86 occupies a relatively large area of the top 82. As best shown in FIGS. 4, 5 and 6, the radially outward surfaces of opening 86 are defined by four identical, longitudinally inclined walls 88*a*, 88*b*, 88*c* and 88*d* arranged in square array radially spaced equidistance from and around the axis 44 to define and limit the radially outward movement to the four fully actuated positions of the actuator button 58 as shall be described. They are disposed transversely to the direction of movement of the button 58. As best seen in FIG. 6, each of the inclined surfaces 88*a*, 88*b*, 88*c* and 88*d* are defined by axially aligned side surfaces 90*a* and 92*a*, 90*b* and 92*b*, 90*c* and 90*d* and 92*d* respectively which prevent the actuator button 58 from being rotated from one to the next adjacent actuated position when in a fully actuated position as will be described. The opposed side surfaces 90*a*–92*a* through 90*d*–92*d* respectively are disposed parallel to the radial directions of movement permitted and are parallel with a radial plane through the axis intersecting the respective inclined surfaces 88*a* through 88*d* to provide four locator slots for the actuator means 48 in the movement from center off to the actuator position modes. The angle of inclination of surfaces 88*a* through 88*d* to the longitudinal axis 44 is shown to be relatively small (in the vicinity of 10°) and is determined by the geometry of the relative size and locations of the first pivot means 46, actuator means 48, fixed contact means 52, movable contact means 54 and separate pivot means 50.

Surfaces 88*a* through 88*d* individually serve as substantial rugged overtravel stop surfaces for the switch in their coaction with a square hub 202 (to be later described) of the actuator button, the relative location and size of hub 202 being shown in its center off position in opening 86 by the dash lines of FIG. 6. It will be noted that the hub 202 is spaced a relatively short distance from the respective surfaces 88*a* through 88*d* when in its center off position and in switch of the size depicted in FIGS. 1–3, on the order of 5/100 of an inch as measured at the greatest radial extent of surfaces 88*a* through 88*d* where they intersect the top surface 82.

The outer casing means 64 is formed with cylindrical interior seal chamber 94 adjacent the top end 82. The seal chamber 94 is defined at its upper end by transverse surface 96 and its lower end by radial interior seal shoulder 98. The seal shoulder 98 is intermediate the relatively radially and longitudinally larger cylindrical bore 100 which together with the insert means 66, 68 and 70 define the sealed operating internal lower chamber 102 of the switch when bore 100 is closed off by the bottom closure insert means 70. Longitudinally aligned semicircular key ways 104*a* and 104*b* are formed in the side walls of bore 100 in opposed relation to coact with the insert means 66, 68 and 70.

Figure 18:
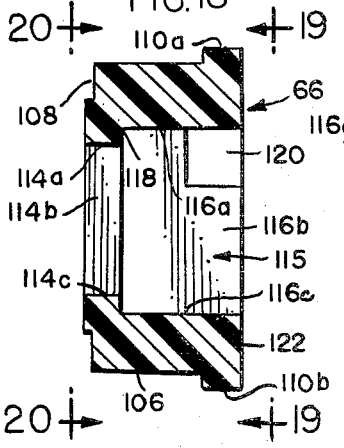
FIG. 18 is a sectional side elevational view along lines 18—18 of FIG. 19 of the upper insert portion of the switch casing rotated 90° from the position shown in FIG. 4.
Figure 19:
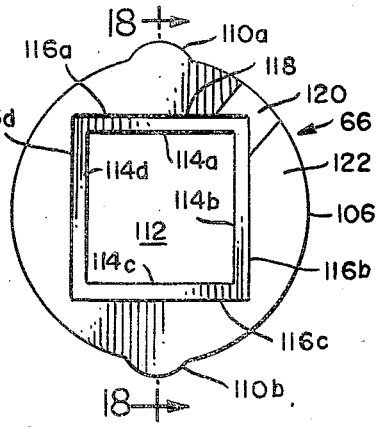
FIG. 19 is a bottom view of the insert shown in FIG. 18.
Figure 20:
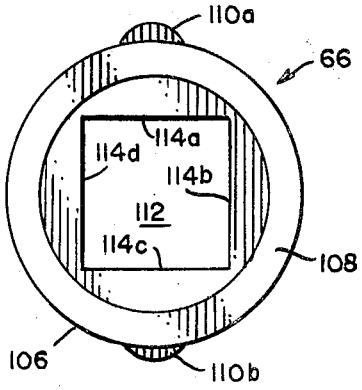
FIG. 20 is a top view of the insert shown in FIGS. 18 and 19.

The upper casing insert means 66 is shown in FIGS. 18, 19, 20 and in FIG. 4 and has a cylindrical shape outer surface 106 complimentary in size to bore 100 and fits therewithin in fixed assembled relation thereto. The upper surface of casing insert means 66 is relieved to provide a radial peripheral sealing shoulder 108 in opposed relation to shoulder 98. The lower end of insert means 66 is formed with peripheral axially aligned opposed bosses 110*a* and 110*b* of relatively short axial extent. The top of the bosses 110*a* and 110*b* stops on the top of key ways 104*a* and 104*b* to locate the insert means 66 relative to outer casing means 64 to provide a small radial chamber between sealing surfaces of 98 and 108 which coact with a portion of the sealing means 72. The bosses 110*a* and 110*b* coacting with key ways 104*a* and 104*b* assure precise assembled relationship between insert means 66 to the outer casing means 64 whereby precise alignment and orientation of the cruciform aperture 86 in the outer casing means with internal surfaces of the insert means 66 is assured and now will be described.

The top of insert 66 is formed with a square central aperture 112 which opens into a large rectangular chamber 115. Aperture 112 is formed and defined by a square array of wall surfaces 114*a*, 114*b*, 114*c* and 114*d* which do not enter into critical coacting relationship with other parts in this embodiment except to be so sized and spacedly located from each other and relative to the rest of the geometry of the parts so that they are not engaged under normal conditions of use by the actuator means 48 lower portions which extends through the aperture 112 as best seen in FIG. 4. It is important that the top of chamber 115 be spaced from the top of insert means 66 sufficiently to afford backup structural strength and non flexing dimensional stability to the shoulder surface 118 under conditions of high G forces and shock.

The rectangular chamber 115 is formed with a square array of walls 116*a*, 116*b*, 116*c* and 116*d* equidistantly spaced from the longitudinal axis. Connecting each wall with corresponding wall surfaces 114*a* through 114*d* is pivot shoulder 118 which, as best seen in FIG. 19, is a square annulus in configuration. The areas where each of the walls 116*a*, 116*b*, 116*c*, and 116*d* join the shoulder 120 form the first pivot means 46 of the switch for coaction with the actuator means 48. In the configuration shown, there are four separate pivot areas, each being respectively disposed below and in diametric alignment with the locator slots that form the cruciform aperture 86 in the top surface 82. It will be appreciated that the exact dimension between the side walls, 116*a*, and 116*c* for example, may be varied with varying of dimensions of other components and surfaces; however the diametric orientation of the side walls 116*a* through 116*d* to the locator slots is critically important as will be explained. As best shown in FIGS. 18 and 19, a cutout 120 is formed in bottom surface 122 of the upper insert means 66 extending between the outer periphery and chamber 115 for access of a flexible common terminal strap. It will also be noted that the side walls between the chamber 115 and the periphery of the insert means are relatively thick and the corresponding flat surfaces 122 are relatively large, both of which impart dimensional stability and ruggedness to the assembly.

Figure 21:
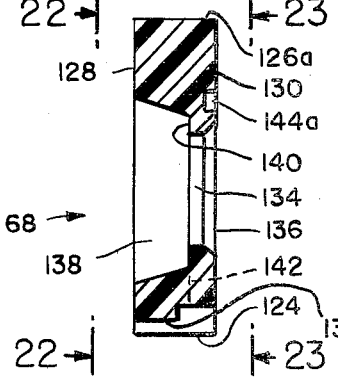
FIG. 21 is a sectional view along lines 21—21 of FIG. 23 of the middle switch casing insert shown in FIG. 4 rotated 90°.
Figure 22:
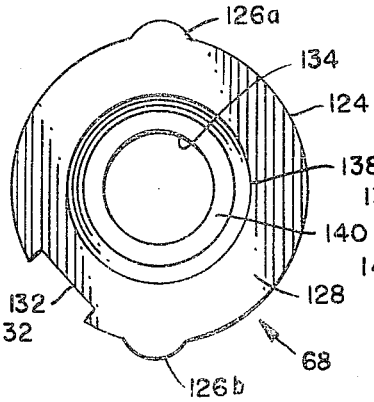
FIG. 22 is a bottom view of the insert shown in FIG. 21 and 23.
Figure 23:
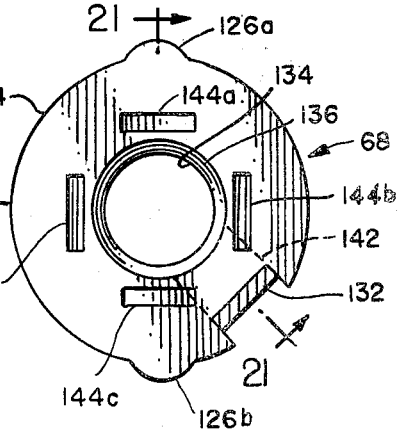
FIG. 23 is a top view of the insert shown in FIGS. 21 and 22.

The middle casing insert means 68 is disc like in overall configuration and is assembled immediately below insert means 66 (and is shown in isolation in FIGS. 21, 22, and 23). Its essential functions are to provide biasing spring guide means and to impart stability for the fixed contact means 52. The insert means 68 also has a cylindrical surface 124 sized to fit bore 100 and axially aligned oppositely disposed bosses 126*a* and 126*b* to fit key ways 104*a* and 104*b* to orient and align the insert means 68 to the remainder of the assembly. It is formed with top surface 128 which mates with surface 122 of upper insert 66 as shown in FIG. 4. A bottom surface 130 is parallel with surface 128 and is relieved on the outer periphery and side surface with a stepped cutout 132 to accommodate the common terminal shown in FIG. 4. A central through aperture 134 is formed in bottom surface 130 having a chamfered edge 136. The size of bore 134 is of no particular criticality except to be large enough to permit non interfering movement of the movable contact means 54 which extends through it as shown in FIG. 4.

The upper surface 128 is formed with a deep conical bore 138 terminating in a radially inwardly directed spring shoulder 140 which together with sides of bore 138 retains and centers the bottom of the metal coil spring biasing means 56. The coil spring biasing means surrounds the movable contact means 54, has multiple functions to be described, and is dimensioned to afford clearance for movement of the lower portion of the movable contact means 54. As shown in dotted lines in FIGS. 4, 21 and 23, the periphery of the insert means 68 may be cut out at 142 to permit assembly of the preferred form of common terminal means 184 (see FIG. 26) for relatively low amperage application (approx. 3 amps or less).

The bottom surface 130 is formed with four axially aligned precisely orientated recesses 144*a*, 144*b*, 144*c* and 144*d* in radial alignment with one of each of the pivot surfaces of the first pivot means and in square array around through bore 134. The recesses 144*a* through 144*d* are located and dimensional to snugly receive the top portions of the respective fixed contact terminal 172*a* through 172*d* to assure fixed stable location of the fixed contacts 172*a* through 172*d* under conditions of high G force and shock. The recesses 144*a* through 144*d* and thus the fixed contact terminals 172*a* through 172*d* are in precise orientation in the same radial plane with surfaces 116*a* through 116*d* and in the same diametric plane as one of the locator slots in top 82 previously described.

Figure 24:
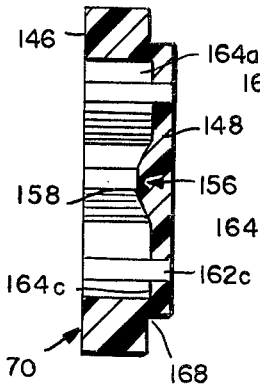
FIG. 24 is a sectional view of the bottom switch closure insert along lines 24—24 of FIG. 25 and rotated 90° from the position shown in FIG. 4.
Figure 25:
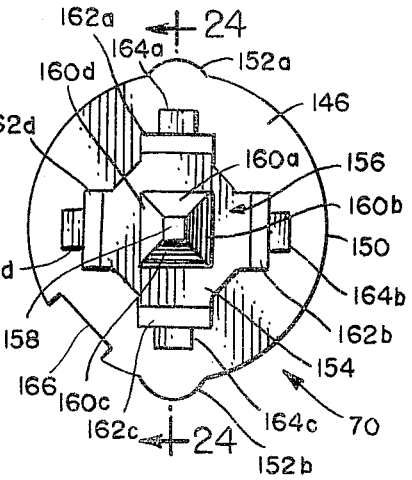
FIG. 25 is a top view of the insert shown in FIG. 24.

The bottom insert means 70 is also disc like in shape and is shown in FIGS. 4, 24 and 25 having a top surface 146, a bottom surface 148 and an outer periphery cylindrical surface 150. The insert means 70 is snugly fitted in the bottom of the outer casing means 64 with top surface 146 mating with bottom surface 130 of insert means 68. Oppositely disposed peripheral bosses 152*a*–152*b* are formed to coact with key ways 104*a* and 104*b* to maintain assembled orientation.

The insert means 70 is formed with a cruciform shaped chamber 154 recessed into top surface 146 (best seen in FIG. 25) which, when assembled as shown in FIG. 4 is oriented with the cruciform opening 86 in the outer casing means 64. It is to be noted that this orientation does not hold for switches having an odd number of "on" modes discussed in connection with FIG. 31 where the 180° rotation orientation is required. Centrally located on the bottom of recess 154 is a truncated pyramidal shaped abutment means 156 having a small square top surface 158 and four sloping side surfaces 160*a*, 160*b*, 160*c* and 106*d* which are precisely oriented and angled as will be described in connection with the coaction with the bottom end of the movable contact means 54. The center of the top surface 158 is on the longitudinal axis 44 and the surface is transverse to that axis.

The bottom surface 148 is formed with four rectangular apertures 162*a*, 162*b*, 162*c* and 162*d* which are in square array around the axis 44 directly below recesses 144*a* through 144*d* respectively. As best shown in FIGS. 25 and 4, radial rectangular recessed cutouts adjacent the respective apertures 162*a* through 162*b* form retaining and locating shoulders 164*a*, 164*b*, 164*c* and 164*d* to coact and retain the assembled fixed terminals 172*a* through 172*d*.

A rectilinear common terminal cutout aperture 166 is formed in the periphery of the insert means to accept the common terminal 174 which is assembled therewithin. As shown in FIGS. 24 and 4, the bottom surface periphery may be relieved at 168 whereby a suitable potting compound 170 wit dielectric and adhesive qualities may be applied to the entire bottom surface 148 to assure good adhesive contact, a tight seal to the interior of the switch 40, and maintains the insert means 66, 68 and 70 in assembled relation to the outer casing means 64. The potting compound 170 also seals the fixed contacts 172*a* through 172*d* and the common terminal 174.

The fixed terminals 172*a* through 172*d* are each formed with a struck out nib (see 176*a* and 176*c* of FIG. 4) respectively to engage shoulder 164*a* through 164*d* respectively. The aforementioned top portions of the fixed terminals 172*a* through 172*d* are located in recesses 144*a* through 144*d* respectively to present flat interior contact surfaces 178*a* through 178*d* respectively to provide a square array of contact surfaces diametrically aligned with the locator slots in the top 82 of the outer casing means 64.

Figure 26:
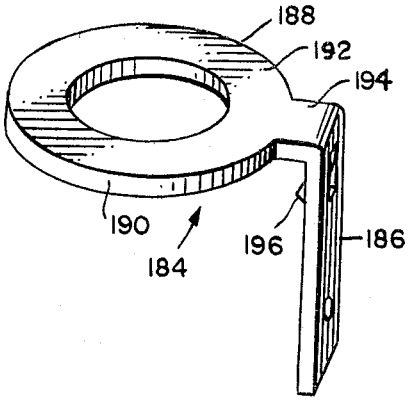
FIG. 26 is an enlarged perspective view of an embodiment of common terminal preferred for lower amperage applications which is inserted intermediate the bottom of the spring and the spring shoulder through an aperture shown in dash lines in FIG. 4 in substitution for the common terminal shown in that figure.
Figure 27:
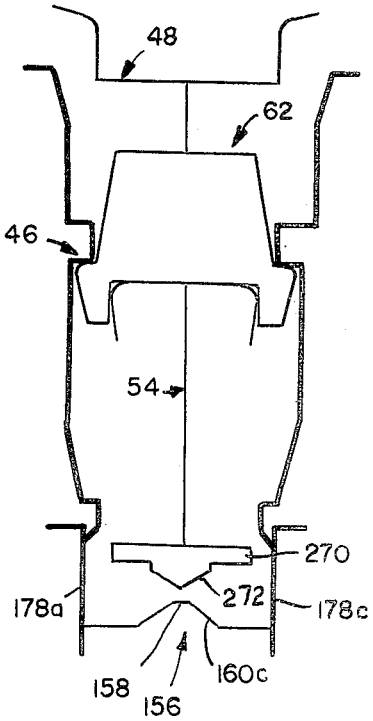
FIG. 27 is a diagrammatic presentation of the relationship of the parts when the switch is in normal center off nonactuated position.
Figure 28:
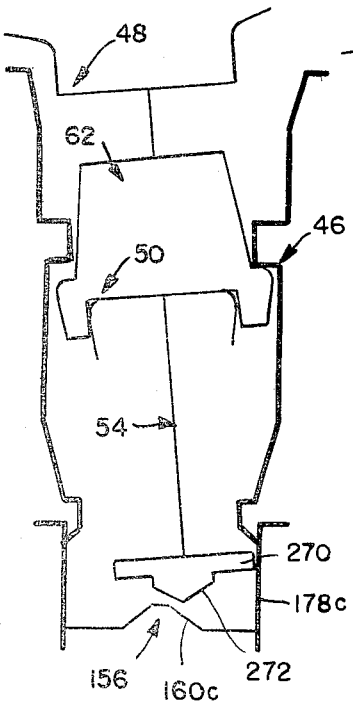
FIG. 28 is a view similar to FIG. 27 showing partial actuation.
Figure 29:
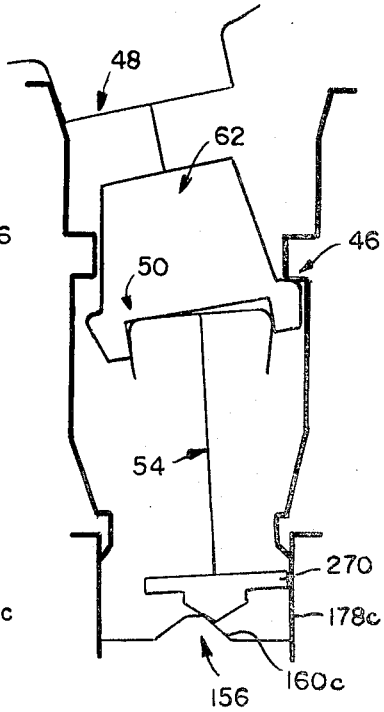
FIG. 29 is a view similar to FIGS. 27 and 28 showing full actuation.

The common terminal 174 in FIG. 4 is offset from the fixed terminals 172*a* through 172*d* and has a flexible braided metal strap 180 soldered to the top thereof. A struck out nib 182 of common terminal 174 engages top surface 146 of the bottom insert means 68 in the cutout recess chamber 132 of the middle insert 68 to locate the common terminal. The preferred construction of common terminal means 184 for low amperage uses (approx. 3 amps and below) is shown in FIG. 26 having an elongated extending leg portion 186 and a washer like body 188 connected to leg 186 by short radially extending portion 194. The bottom 190 of the body 188 is coextensive with the rests (not shown) upon shoulder 140 of insert means 68 when assembled. Access for portions 188 and 194 to be assembled is provided by removing a complimentary portion of insert means 68 along the dotted lines shown in FIGS. 4, 21 and 23. A struck out nib 196 in leg portion 186 serves a similar function to nib 182 already described.

The top surface 192 of the common terminal engages the bottom of coil spring biasing means 56 in good electrical contact therewith. However the longer electrical path through the coil spring biasing means is conductive to too much resistance heating in higher amperage applications.

Returning now to the movable actuator means 48, it will be seen in FIGS. 1 and 4 that the top of button portion 58 is formed with arcuate downwardly stepped segments 198*a* through 198*d* in spaced array around the periphery to provide a shallow central depression area comfortably accepting a human thumb or finger pad to tilt the actuator button into any of the locator slots in the top 82 of casing means 64. The locator slots are aligned with the ends of the cruciform area 199 on the top of the actuator button intermediate the raised portons 198*a* through 198*d*. Suitable indicia means, such as the numbers 1, 2, 3 and 4 may be placed as shown, however it will be appreciated that in the size shown, there is little room for extensive indicia.

Figure 7:
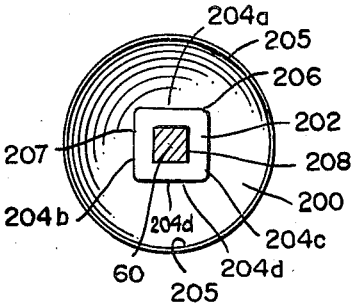
FIG. 7 is a sectional view through the actuator button shaft to show the configuration of the under side of the actuator button taken along lines 7—7 of FIG. 2, with the actuator button and shaft being shown disassociated with the casing shown in FIGS. 5 and 6.
Figure 8:
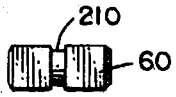
FIG. 8 is a side elevational view of the actuator shaft disassembled from the actuator button.
Figure 9:
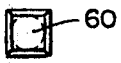
FIG. 9 is an end view of the actuator shaft shown in FIG. 8.
Figure 10:
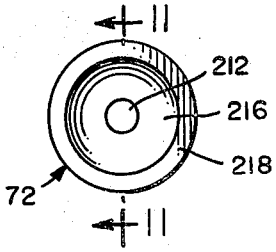
FIG. 10 is an isolated bottom view of the flexible sealing member used in the switch.

As shown in FIGS. 4 and 7, the underside of button 58 is formed with an annular recess 200 to define a central hub 202 which is precisely dimensioned and has a square outer periphery as viewed in FIG. 7, the recess 200 and its relationship with the top 82 and bevel surface 84 when the switch is in center off and one of the actuated positions is shown in FIG. 4. It will be perceived that the recess 200 is configured and dimensioned to defined contact zones 201 and 203 with te outer peripheral edge of bevel surface 84 and the confluence of surface 82 and one of the surfaces 88*a* through 88*d*, under certain conditions to provide stop surfaces limiting travel of the button 58 in a direction parallel (at approximately 10° inclination toward the axis) to any of the individual inclined surfaces 88*a* through 88*d*. Further, peripheral edge surface 205 of recess 200 is engageable with bevel surface 84 to limit movement of the button 58 in directions generally along the axis 44 and at angles inclined less than the inclination of surfaces 88*a* through 88*d* previously described. If additional protection is desired, coacting interfering surfaces (not shown) of the button recess 200 and the top surface 82 and bevel 84 can be arranged to limit axial overtravel of the button while permitting the tilting action shown. The limitation of axial movement just described prevents undue stress on the moving parts and precision surfaces interior of the switch 40 so that repeatable precision actuation in excess of 100,000 cycles in each of the four modes may be performed.

The hub 202 has four sides 204*a*, 204*b*, 204*c* and 204*d* in square array equidistantly spaced from axis 44 and aligned therewith when the button 58 is in center off position. As best shown in FIG. 7, the outer corners 206 are slightly rounded. The hub 202 has an end surface 207 which at its outer periphery joins side surfaces 204*a* through 204*d* which can, under certain conditions, become a pivotal edge (at Pt. D in FIG. 30) on the respective stop surfaces 88*a* through 88*d*.

Th interior of the hub 202 is formed with a central rectangular recess 208, the sides of which are parallel to outer hub surfaces 204*a* through 204*d*. A relatively heavy stubby metal rectilinear shaft 60 having a central circumferential annular channel 210 has the upper portion thereof snugly attached to the walls of recess 208. The channel 210 receives the edge surfaces of sealing means 72 as will be described.

Attached to the lower end of actuator shaft 60 below channel 210 is the actuator rocker means 62, the top surface of which also engages the flexible sealing means 72. The flexible sealing means 72 has an overall bell shape similar to a so called "plumber's helper"0 with a central through aperture 212 with a thickened margin 214 which is stretched over to sealingly engage the surfaces of groove 210 of the shaft 60. The margin 214 is integral with flexible wall 216 and the thickened outer margin 218 which is trapped between sealing shoulders 98 of the outer casing means 64 and shoulder 108 of the insert means 66 when the switch is assembled. The thickened margins 214, 218 and connecting portion 216 are preferably of a good grade of rubber or synthetic plastic which will prevent leakage of air at a rate not to exceed $1\times10^{-8}$ standard atmospheric cubic centimeters per second under temperature extremes of −65° C. to +85° C., high humidity, and repeated flexings in excess of 400,000 times.

The actuator rockers means 62 is shown in FIGS. 4, 12, 13 and 14 formed with a rectangular recess 220 in the upper end to accept the lower end of shaft 60. The upper outer portion 222 is of truncated pyramidal shape as best seen in top view FIG. 14 and extends through and in the embodiment shown, does not engage the surfaces 114*a* through 114*d* of aperture 112 in any position of the actuator means 48.

It is possible to use the surfaces 222 for interaction with side surfaces 114*a* through 114*d* as stop surfaces as will be appreciated, however, the coaction of the hub surfaces 204*a* through 204*d* with surfaces 88*a* through 88*d* is preferred since they are nearer the points of application of force to the actuator means 48.

The rocker means 62 is formed with a square annular transverse shoulder having surfaces 224*a*, 224*b*, 224*c* and 224*d* which pivotally coact with shoulder surface 120 on insert means 66. A square array of side surfaces 226*a*, 226*b*, 226*c* and 226*d* are formed on the lower periphery of rocker means 62 below shoulder surfaces 224*a* through 224*d*. Each of the side surfaces 226*a* through 226*d* join the respective transverse surface 224*a* through 224*d* with a rounded edge 225*a* through 225*d* and are inclined toward the longitudinal axis so that they do not engage surfaces 116*a* through 116*d* except in the vicinity of edge surfaces 225*a L through 225d* on actuation of the switch.

The bottom of rocker means 62 is formed with a rectilinear recess 228 having a transverse end surface 232 with axially aligned side surfaces 230*a*, 230*b*, 230*c* and 230*d* in square array and equidistantly spaced from the axis to form the separate pivot means 50. The surfaces 230*a*, 230*b*, 230*c* and 230*d* are oriented and aligned with edge surfaces 225*a* through 225*d* respectively and thus with the locator slots in top 84 of the out casing means 64 when assembled as shown in FIG. 4.

It will be obvious from the foregoing description that the actuator means 48 of the four position "on", center "off" embodiment is symmetrical in all coactions with the outer casing means 64 and thus does not require a particular orientation in assembly unless there are predesignated indicia means on button 58 which require orientation with mounting boss 80. The symmetrical design of the actuator means 48 also assures identical precision actuation in all modes which gives the same "feel" to the human operator.

The movable contact means 54 is mounted on the actuator rockers means 62 for movement with pivotal action on the separate pivot means 50. The movable contact means 54 essentially comprises the contact rocker means 234, the current carrying shaft means 236, and the contact and latch means 238. It will be seen that the contact rocker means 234 has a complex configuration and thus is preferably made of a mouldable hard dielectric material, such as nylon or the like. The shaft means 236 is made of metal such as brass rod coated with silver, to both impart structural strength to withstand the lever forces involved and to carry electrical current; and the contact portion of the contact and latch means must be of electrical current carrying material, and is shown here as metal such as a suitable alloy or silver.

Figure 15:
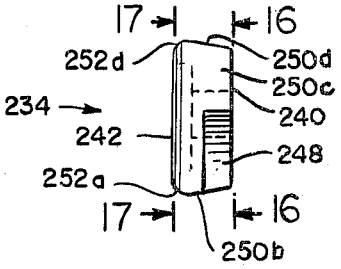
FIG. 15 is a side elevational view of the upper portion of the movable contact means rotated 90° from the position shown in FIG. 14.
Figure 16:
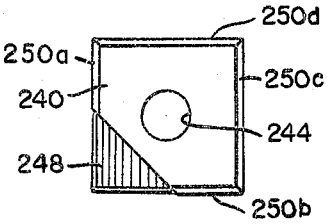
FIG. 16 is a side view of movable contact portion bottom as viewed along lines 16—16 of FIG. 15.
Figure 17:
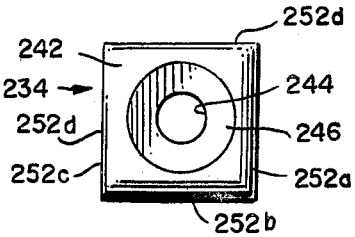
FIG. 17 is a view along lines 17—17 of FIG. 15.

The contact rocker means 234 is formed with a bottom surface 240, a top surface 242 and a through centrally located mounting bore 244 seen in FIGS. 15, 16, 17 and 4. An enlarged retaining counter bore 246 is formed in top surface 242 and the lower surface 240 is cut out at 248 as best shown in FIGS. 15 and 16 to permit access of terminal strap 180. The contact rocker means 234 is formed with 4 axially inwardly downwardly inclined side surfaces 250*a*, 250*b*, 250*c* and 250*d* in square array, each of which join top surface with a rounded edge surface 252*a*, 252*b*, 252*c* and 252*d* which coact with the separate pivot means 50 on the actuator rocker means 62. The dimensioning and sizing of the contact rocker means is extremely critical. The distance between parallel sides 250*a* and 250*c* (and 250*b* and 250*d*) at their greatest dimension adjacent rounded edges 252*a* through 252*d* is preferred to typically be only 1/1000 of an inch less than the dimension between sides 230*a* and 230*c* (and 230*b* and 230*d*) of the actuator recess 228. This prevents skewing of contact rocker means 234 relative to the actuator means 48, permits repeatable reliable transmission of the actuator force, and permits reliable repeatable transmission of the biasing force of the spring biasing means 56 through the contact rocker means 234 to the actuator means to afford pivotal action about the separate pivot means 50 and the pivotal action about the first pivot means by the actuator means 48 on the switch casing means 42. It also insures that the parts return to alignment with the longitudinal axis 44 under the bias force of the biasing means 56 when no exterior force is applied to the actuator means 48 for repeatable precision and operator feel. It will be noted also that top surface 242 must be coplanar smooth and is transverse to the axis so as to not introduce an advertant pivot area.

The contact rocker means 234 is rigidly mounted on the reduced diameter upper stub portion 254 of the shaft means 236 by a suitable washer 256 disposed in counter bore 246, the bottom 240 mountingly engaging an enlarged stepped washer 260 which in turn is on shaft means 236 transverse shoulder 258, all as will be seen in FIG. 4. The upper washer 256 may be swaged to the stub end 254 as shown or by other suitable means, it being important that the washer 256 remains below the plane of top surface 242 and the washer 256, stepped washer 260 and contact rocker means all are in rigid precise relationship in the axial and transverse planes. The stepped washer 260 provides a spring receiving shoulder 262 whereby the biasing means spring 56 can surround the mid portion of the movable contact means 54 and provide the several functions described and not interfere with movement of the movable contact means.

The contact shaft means 236 has an elongated section 264 which is formed with an end bore recess 266 which receives combination mounting member and latching means 268 as shown in FIG. 4. The mounting and latching means 268 is generally of a conically headed nail shape having a body 269 to rigidly attach to the walls of bore 266 and a transverse shoulder 273 to engage and trappingly rigidly mount contact washer 270 to the end of shaft portion 264 as shown in FIG. 4. The outer periphery 271 of washer 270 is radially larger than shaft portion 264 and is the electrical contact surface of the movable contact means 54.

The head portion of means 268 is conical in shape as shown at 272 and angled complimentary to the angle of the sides 160*a* through 160*d* of the abutment means 156 for coaction therewith.

Figure 30:
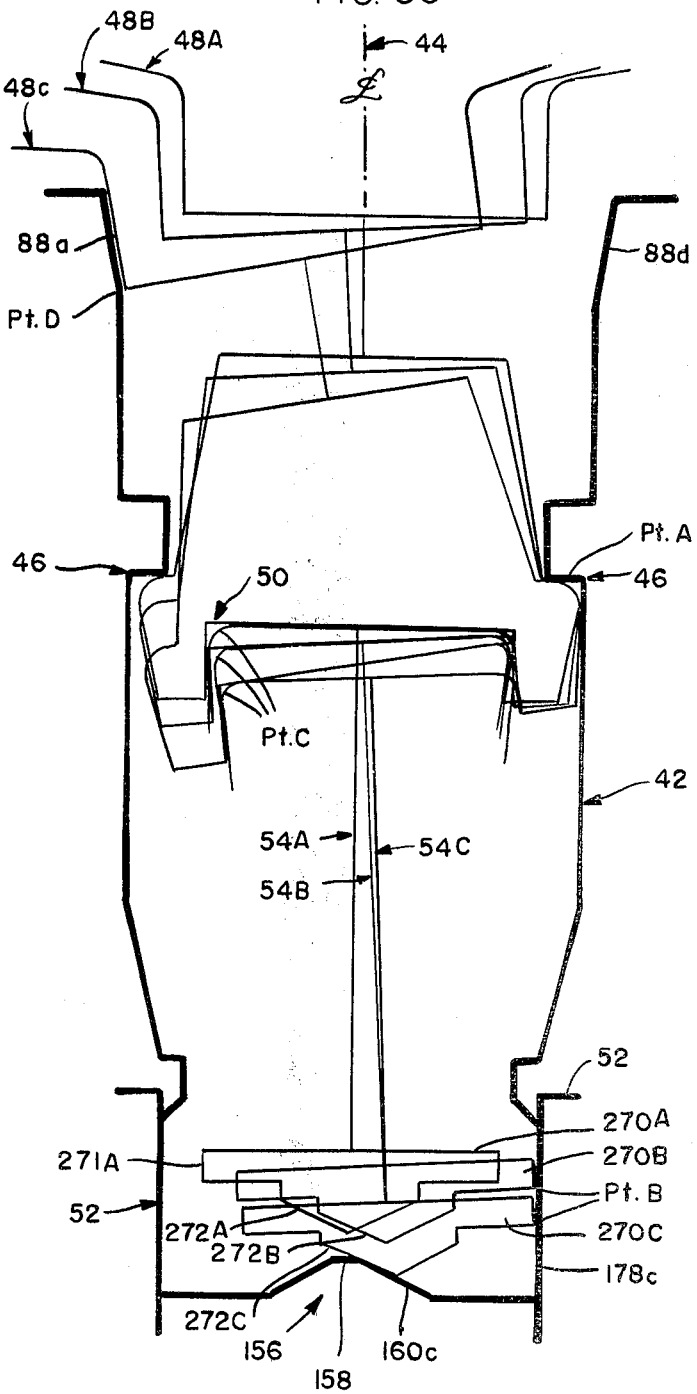
FIG. 30 is an enlarged composite view of FIGS. 27, 28 and 29 superimposed on each other.

In the embodiment shown, movement of the actuator means 48 approximtely 7½° of arc from the central axis 44 along any of the four paths defined by the locator slots in the top 84 of the outer casing means 64 will cause the actuator rocker means 62 to pivot at the first pivot means 46 in the same diametric plane and on the opposite side of the outer casing means. Because biasing means 56 urges the contact rocker means 234 into engagement against surface 228, the movable contact means 54 maintains columnar alignment with the actuator means 48. In the size shown in FIGS. 1–3 movement of the actuator button 7½° of arc translates to approximatey 3/1000th's of an inch of movement. Such movement will cause contact of surface 271 of contact 270 with a fixed contact means 52 located on the same side (radial plane) as the pivotal action on the first pivot means 46 at Pt. A. This is shown diagrammatically in the movement from the center off position of the parts in FIG. 27 to the positions in FIG. 28. It is also shown in FIG. 30 where the center off position of the parts uses the same reference numbers as previously used with a suffix of an "A", the position of the parts when in electrical make position of FIG. 28 being shown with the suffix "B" and the full overtravel position of the parts of FIG. 29 being shown with the suffix "C" all for ease of reference and to aid in visualizing movement in FIG. 30.

During movement from center off to initial electrical contact position, portions of the actuator means 48 move along and relative to the longitudinal axis to in turn impart radial and a very slight longitudinal downward movement to contact 270 because of the geometry involved. This is most clearly seen in FIG. 30. The movement of actuator means 48 from approximately 7½° of arc to approximately 15° of arc (another 3/1000th's of an inch) i.e., from first contact of FIG. 28 to full overtravel stop of FIG. 29 (positions B and C of FIG. 30) causes a number of complex interactions. As can be seen in FIG. 30, the contact surface 271 (see FIG. 4) is constrained from further radial movement by engagement with a fixed contact such as 178*c* and thus is forced to wipedly move downwardly from the position 270B to the position 270C when the movable contact means 54 is forced to pivot upon the separate pivot means 50 on the actuator means 48 at Pt. C on the diagrammatic drawing FIG. 30 (the confluence of side 230*c* and surface 228 in FIG. 4). It will be noted that Pt. C is in its entirety moving in an arcuate path with components of movement along and toward the axis 44. The movable contact means 54 pivots on moving separate pivot means 50 (Pt. C) and slightly on shifting Pt. B on the wiping zone as the movable contact means 54 moves from position B to position C of FIG. 30.

It will be observed that the downward movement of the movable contact means just described causes the conical head surface 272 to also move downwardly and become aligned and trapped behind a pyramidal side surface (here shown as 160*c*) of abutment means 156. It will also be observed that during the travel from 7½° toward 15° by the actuator means, it is possible for the operator to accidentally stop arcuate movement about first pivot means Pt. A and push in a direction parallel with axis 44. However, this will not cause the contact surface 271 to leave electrical contact with the fixed contact means 52 since the contact rocker means will pivot back toward columnar array with the actuator means 48. Further, once the zone of arcuate travel about 7½° of arc is reached and maintained, including engagement of the actuator button hub surfaces on the top surfaces (e.g. 204*a* with 88*a*) and a new pivot Pt. D is introduced, no movement of the actuator means in any direction permitted by the geometry will cause the contact 270 to disengage since the abutment means 158 prevents such disengagement (the conical head surface 272 engaging one of the surfaces 160*a* through 160*d*) until the center of button 58 is back close to the axis 44.

It will be observed that in the construction shown there are five concentric zones of operation for the actuator means 48. One, the center off or zero zone; two, the zero to 3½° of arc zone; three, the 3½° to 7½° of arc zone; four, the 7½° to 15° of arc zone; and five, the full stop at 15° of arc zone. In zone one, axial depression of the actuator means 48 causes no movement of the contact 272 toward the fixed contact, but causes the end of head 272 to engage top surface 158 of the abutment means 156 to provide position stop (unless button and top surface intereference previously described is provided). In zone two, the end of head 272 is vertically above square surface 158 unless there is axial depression of button 58 sufficient to move surfaces 224*a* through 224*d* away from contact with shoulder surface 120 simultaneously, the contact 270 moves relatively toward a fixed contact but is not in engagement unless the tilt and axial depression of button 58 together are sufficient to move the side 272 into one of the surfaces 160*a* to 160*d* of abutment means 156 and force surface 271 into engagement with a fixed contact means 52, the hub 202 on the button 58 approaches but is not in a locator slot and some pivotal action about the first pivot means 46 or about surface 158 normally occurs unless depression axially along with tilt removes the pivotal contact and there is a pivotal action on the center of motion of biasing spring means 56. In zone two it is possible to sequentially move the button 58 from one to the next adjacent locator slot without returning to dead center zone one.

In zone three, the end of head 272 is normally vertically above one of the pyramidal sides 160*a* through 160*d* of the abutment means, the contact 272 has not yet normally obtained contact with a fixed contact unless axial component of movement of the button 58 forces surface 272 down a side 160*a* to 160*d* to force engagement, hub 202 is in one of the four locator slots in outer housing means 64 top surface 82, and pivotal action about the first pivot means normally has occured unless there is some pivotal action on the center of motion of the biasing means. In zone four, contact of surface 271 with a fixed contact is virtually assured until the retreat to zone three. While it is theoretically possible to move contact surface 271 away from the fixed contact and balance the actuator means and rocker means on the spring means in the 7½° to 8° zone of arc, the off center compression of the spring biasing means 56 will tend to urge the movable contact means 54 so as to maintain electrical contact and it is difficult to tease the switch into exact balance of forces so as to achieve electrical break in this narrow area of actuation. In the other part of zone four after approximately 8° of actuation, the geometry contact is maintained. In zone five, even though a new pivot point "D" is introduced, permitting a reverse buckling action in the absence of the abutment means 156, the abutment means in coaction with surface 272 prevents the contacts from breaking electrical connection.

The actuator movement travel is extremely small. However, the biasing force of biasing means 56, a characteristic of the thumb or finger pad of a human operator, and the geometry assures that definitive actuation is required. More particularly, when the fleshy pad of an operator (not shown) engages the cruciform depression 199 at the top of button 58, it is possible to move the top of a finger or thumb approximately ⅛ inch in all directions without the thumb or finger surfaces that actually engage the button 58 moving relative to the button surfaces or the button moving with respect to the other casing means 64. In the actuation of the switch, the biasing force of the spring means 56 assures that the skin of the fleshy pad is stretched tight in each direction of movement. Thus the top of a finger or thumb must move approximately 3/16 of an inch in each direction from center off in order to cause travel to full over travel stop. In the commercial embodiment shown in FIGS. 1–3, the geometry and the coactions provides a very stable switch however, the operating force required is only approximately 16 oz.

Figure 31:
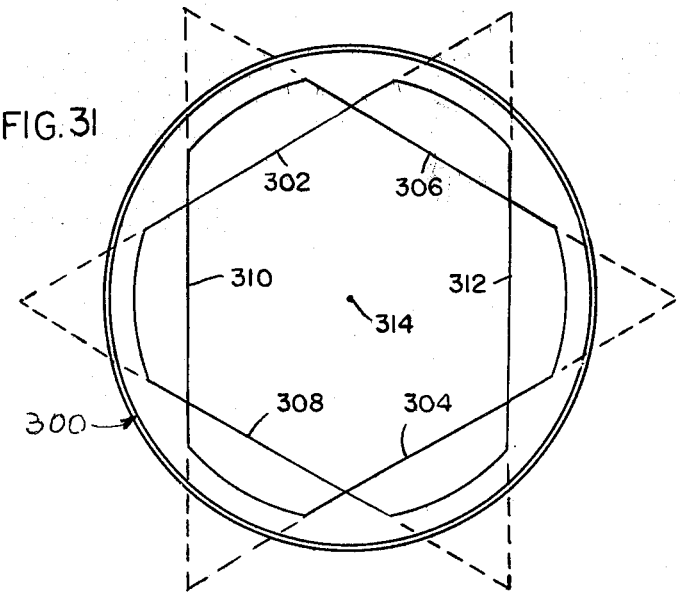
FIG. 31 is a diagrammatic view showing the orientation of operating surfaces in alternate embodiments using the inventive concepts.
Figure 11:
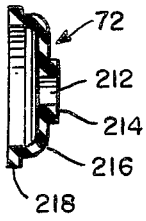
FIG. 11 is a sectional view along lines 11—11 of FIG. 10.

An alternate embodiment switch 300 is shown diagrammatically in FIG. 31. This figure diagrammatically orients the top view orientation of operating surfaces of a three position center off or a six position center off switch. The switch 40 may be designed using the inventive concepts in any of a number of regular figure forms other than the square. When a three position switch is desired, top opening 86 will be formed with top surfaces and the separate pivot means 50, both of which will be parallel with 302, 308 and 312, which are in triangular array as shown by the dotted construction lines. The surfaces of the first pivot means 46 is oriented parallel with triangularly arrayed surfaces 306, 304 and 312 i.e. 180° rotated from surfaces 302, 308 and 312 around the longitudinal axis 314. The surfaces of the abutment means and the fixed contact means will also be oriented parallel with surfaces 306, 304 and 312.

It will further be noted that while the first pivot means 46 of FIGS. 1–30 is shown above the separate pivot means 50, this is not a necessary relationship. Further the utilization of the inventive concepts permits a large number of design variables to obtain desired operating characteristics. Lever transmission of forces can be changed by changing the relative dimension between pivot surfaces.

In alternative embodiments using center off and one, two, three, five or six etc. positions, i.e. those other than the four position switch shown in detail, certain relationships of the four position switch should be maintained. The direction of the tilt of the actuator means permitted by the locator slots, the location of one of the fixed contact that is engaged by the movable contact means, the location of the first pivot means and the location of the separate pivot means are such that they are all coacting in the same diametric plane through the longitudinal axis of the switch. Further the direction of the tilt of the actuator means along a radial plane and the location of the separate pivot means are such that the latter intersects (preferably transversely) that radial plane. The over-travel stop surface is located in parallel relationship with the separate pivot means. The location of the first pivot means and one fixed contact means are such that they are parallel and intersect the same radial plane. In all switches having an odd number of "on" permissible switch positions (other than 1) such as 3, 5, 7 etc., the array of stop surfaces and separate pivot means maintain their parallel relationship to the fixed contact means and first pivot means. Also, the first pivot means, the separate pivot means, the fixed contact means, and the stop surfaces are in transverse intersection to the diametric plane of the direction of tilt. However, they are in two different sets of radial planes. Thus the stop surfaces and separate pivot means radial plane is on the opposite side of the axis (180° offset) from the first pivot means and fixed contact means radial plane.

Great flexibility in providing operating characteristics is permitted using the inventive concepts within any predetermined envelope size (switch casing parameters). Relatively strong biasing means can be used to impart good stability and shock resistance characteristics while using relatively light operating force, since lever action is used to compress the spring during actuation. This is not at sacrifice of high unit pressure of the movable contact surface 271 against the fixed contact surface because of the line contact involved dictated by the respective geometrics of these components.

It will also be observed that the components of the switch are few, are well adapted to mass production techniques, and are relatively easy to assemble.

While in the foregoing specification detailed descriptions of specific embodiments of the invention were set forth for the purpose of illustration, it will be understood that many of the details hereingiven may be varied considerably by those skilled in the art without departing from the spirit and scope of the invention.

I claim:

1. An electrical switch comprising: switch casing means having a longitudinal axis, first pivot means associated with said switch casing means, actuator means movably mounted relative to said switch casing means about said first pivot means, said actuator means being alignable with and movable from alignment with said longitudinal axis, separate pivot means associated with said actuator means and offset from said longitudinal axis, fixed contact means located in offset relation to said longitudinal axis, movable contact means having first and second ends alignable with said longitudinal axis, said first end of said movable contact means being pivotably coactable with said separate pivot means, said second end being movable from alignment with said longitudinal axis toward for coaction engagement with said fixed contact means, biasing means operable to bias said movable contact means and said actuator means into alignment with said longitudinal axis, said biasing means being operable to bias said first end into pivotal engagement with said separate pivot means and said second end away from said fixed contact means, whereby movement of said actuator means from alignment with said longitudinal axis and about said first pivot means provides movement of said second end of said movable contact means toward engagement with said fixed contact means and the further movement of said actuator means after engagement of said second end of said movable contact means with said fixed contact means is permitted and operable to provide overtravel movement of said actuator means.

2. The switch of claim 1 wherein, said first pivot means and said separate pivot means are each located in spaced offset relationship to said longitudinal axis, said first pivot means being so constructed and arranged as to permit movement of said actuator means both along and transverse to said longitudinal axis, said separate pivot means being so constructed and arranged as to permit movement of said second end of said movable contact means along an axis offset and parallel to said longitudinal axis to provide exaggerated wiping contact between said second end and said fixed contact means.

3. The switch set forth in claim 2 wherein said switch casing means has a top end, bottom end, top internal shoulder means, and bottom internal shoulder means, both said top and bottom internal shoulder means being longitudinally spacedly located intermediate to said top and bottom ends generally transverse to and offset from said longitudinal axis, said biasing means has top and bottom portions, said top portion of said biasing means engaging said first end of said movable contact means, said bottom portion engaging said bottom internal shoulder means, said top internal shoulder means forming at least a portion of said first pivot means, said actuator means extends through said top end of said switch casing means, and said fixed contact means being located adjacent said bottom end of said switch casing means, whereby said biasing means provides the sole means of assuring pivotal engagement of said movable contact means with said separate pivot means associated with said actuator means and the pivotal engagement of said actuator means with said top shoulder means while permitting movement of said actuator means and movement of said movable contact means along an axis parallel to said longitudinal axis and thereby translate a substantial portion of the pivotal movement of said actuator means into wiping movement of said second end of said movable contact means with said fixed contact means.

4. The switch set forth in claim 1 further comprising means for preventing actuated accidental contact disengagement, said means for preventing accidental contact disengagement being associated with said switch casing means for cooperation with said second end of said movable contact means.

5. The switch set forth in claim 4 wherein the means for preventing accidental contact disengagement is further characterized as being spacedly located and arranged relative to said fixed contact means and said second end of said movable contact means to normally be spaced from said second end of said movable contact means and engageable with said second end subsequent to the engagement of said second end with said fixed contact means during the wiping engagement therebetween.

6. The switch set forth in claim 1 wherein said fixed contact means comprises first and second fixed contact means offsettlingly disposed from and in a plane transverse to said longitudinal axis in first and second radial planes respectively, said first pivot means comprises a first and second pivot surfaces each offsettingly disposed from and in a plane transverse to said longitudinal axis, whereby said first pivot surface intersects said second radial plane, said separate pivot means comprises first and second surfaces each offsettingly disposed from and in a plane transverse to said longitudinal axis, said first pivot surface and said first surface being respectively disposed on opposite sides of said longitudinal axis in a diametric plane and different radial planes whereby movement of said actuator means transversely of said longitudinal axis about said first or second pivot surfaces of said first pivot means causes corresponding movement of said second end of said movable contact means toward respective engagement with said first or second fixed contact means and after respective engagement with said first or second fixed contact means, corresponding pivotal movement of said second end of said movable contact means about said first or second surface of said separate pivot means to provide a multiposition switch.

7. The switch in claim 6 wherein said transverse plane of said first and second surfaces is located intermediate the transverse plane of said first and second pivot surfaces and the transverse plane of said first and second fixed contacts means.

8. The switch of claim 7 wherein each of said first and second pivot surfaces and said first and second surfaces are in rectilinear array, each of the arrays of said surfaces being parallel to each other.

9. The switch in claim 7 wherein said switch casing means is formed with a centrally located top opening having side surfaces, each of said side surfaces being inclined toward said longitudinal axis, said actuator means is formed with a top, bottom, and middle segment, said middle segment extends through said central opening, said top segment being formed with hub surfaces normally spaced from said side surfaces and tiltingly movable into engagement with said side surfaces, said bottom segment being formed with segment surfaces a portion of which are parallel to said hub surfaces on said top segment and cooperable with said pivot surfaces of said first pivot means, said side surfaces, first and second pivot surfaces, first and second ends of said movable contact means, fixed contact means, and separate pivot means being radially and axially relatively disposed each to the other to permit contact of said top segment hub surfaces of the actuator means with said side surfaces of the switch casing means only after said first end of said movable contact means has pivoted on said separate pivot means to thereby provide overtravel stop means to further movement of said actuator means.

10. The switch set forth in claim 9 further comprising resilient sealing means, and wherein said switch casing means is formed with an internal first seal receiving surface offset from said longitudinal axis, said middle segment of said actuator means is formed with a second seal receiving surface, and said resilient sealing means extends between said first and second seal receiving surfaces to permit axial and radial movement of said actuator means relative to said switch casing means.

11. A multi position switch comprising:

(a) switch casing means having a longitudinal axis, (b) a plurality of internal first pivot means on said switch casing means each radially offset from said longitudinal axis, (c) a plurality of spaced fixed contact means internally mounted on said switch casing means, radially offset from said longitudinal axis, and each being located below and in the same radial plane of one of said first pivot means, (d) actuator means selectively movably mounted relative to said switch casing means about each of said first pivot means, said actuator means being normally biased into and movable from alignment with said longitudinal axis, said actuator means being formed with a plurality of separate pivot means radially offset from said longitudinal axis and generally located in diametric plane that includes one of said fixed contact means and first pivot means, (e) movable contact means having first and second ends alignable with said longitudinal axis, said first end being formed with a plurality of pivot surfaces each being coactable with one of said plurality of separate pivot means of said actuator means, said second end being movable from alignment with said longitudinal axis for contact with each one of said plurality of fixed contact means, said movable contact means being pivotally mounted for pivotal action about both said first and separate pivot means, (f) biasing means having first and second portions, said first portion being engageable with said switch casing means, said second portion engaging said first end of said movable contact means to (i) bias said movable contact means into columnar array with said actuator means and into alignment with said longitudinal axis, (ii) bias each of said plurality of pivot surfaces of said first end into pivotal engagement with each of said plurality of separate pivot means on said actuator means, (iii) bias said second end away from each of said plurality of fixed contact means, and (iv) bias said actuator means into engagement with each of said plurality of internal first pivot means and into alignment with said longitudinal axis, whereby a selectively directed actuation force causing selectively directed movement of said actuator means out of alignment with said longitudinal axis and about one of the plurality of said first pivot means in turn provides movement of said second end of said movable contact means toward engagement with one of said fixed contact means, the contacting engagement of said second end of said movable contact means with said one of said fixed contact means while continuing the selectively directed movement of said actuator means causing pivotal movement of said first end of said movable contact means about one of said plurality of separate pivot means to provide a non columnar alignment between said actuator means and said movable contact means and engagement between said second end of said movable contact means and said one of said plurality of fixed contact means, the release of said selectively directed actuation force allowing said biasing means to realign said actuator means and said movable contact means in columnar array and with said longitudinal axis and said second end of said movable contact means out of engagement with any one of said fixed contact means.

12. The switch set forth in claim 11 wherein a differently directed actuation force causes differently directed movement of said actuator means about a different one than said one of said plurality of said first pivot means to in turn provide movement of said second end of said movable contact means toward engagement with a different one than said one of said plurality fixed contact means, the contacting engagement with said second end with said different one of said fixed contact means while continuing the oppositely directed movement of said actuator means causing pivotal movement of said first end of said movable contact means about a different one than said one of said separate pivot means to provide engagement between said second end of said movable contact means and said different one of said plurality of fixed contact means.

13. The switch set forth in claim 12 wherein said switch casing means is formed with a central top aperture having a plurality of sides, each of said sides being radially offset from said longitudinal axis and each being located in a radial plane including one of said plurality of internal first pivot means, said engagement between said second end of said movable contact means and, said different one of said plurality of fixed contact means is a wiping engagement, said actuator means is formed with a plurality of abutment surfaces, each of said abutment surfaces being so located dimensioned and arranged so as to engage one of said sides only after said second end of said movable contact means has made wiping engagement with one of said fixed contact means and prevent further travel of said actuator means in selected directed movement.

14. The switch set forth in claim 13 wherein said switch casing means is formed with bottom centrally located contact abutment means having a plurality of contact surfaces, each one of said contact surfaces being generally opposed to one of said plurality of fixed contact means, said contact abutment means being so dimensioned, located and arranged relative to said fixed contact means, movable contact means, and actuator means whereby said second end of said movable contact means simultaneously engages one of said fixed contact means and one of said opposed contact surfaces of said abutment means to prevent accidental disengagement of said second end of the movable contact means with said fixed contact means in the event of pivotal movement of said actuator means about one of said actuator means abutment surfaces coacting with one of said plurality of sides of said top aperture of said switch casing means.

15. The switch set forth in claim 14 further comprising flexible sealing means, said sealing means being disposed internally of and sealingly engaging said switch casing means intermediate said central top aperture and said first pivot means, said sealing means sealingly engaging said actuator means intermediate said abutment surfaces and said separate pivot means, said flexible sealing means permitting multidirectional movement of said actuator means along and about said longitudinal axis while maintaining sealing engagement with said actuator means and said switch casing means.

16. The switch set forth in claim 14 wherein said plurality of sides of said switch casing aperture are radially aligned in generally square array around said longitudinal axis, said plurality abutment surfaces of said actuator means are formed in generally square array around said actuator means, said plurality of first pivot means are located in generally square array around said longitudinal axis in alignment with said plurality of sides, said plurality of separate pivot means are located in square array around said longitudinal axis in general alignment with said plurality of said first pivot means, and, said fixed contact means are located in generally square array around said longitudinal axis whereby a self aligning center off four actuated position switch is formed.

17. The switch set forth in claim 16 wherein said second end of said movable contact means is formed in annular curvilinear shape to provide curved contact surfaces for engagement with said plurality of fixed contact means, whereby actuating force on said actuator means is transmitted to said movable contact means to exert high unit pressure contact engagement between said curved contact surfaces and said plurality of fixed contact means.

18. The switch set forth in claim 11 wherein said actuator means is formed with a digitally engageable button end portion normally located in centered position on said longitudinal axis, said button end portion being simultaneously movable relatively short distances along and transverse to said longitudinal axis and normally in an arcuate path around each said first pivot means, said button end portion also being located and arranged a predetermined distance from said first pivot means, said movable contact means second end being located and arranged a greater distance than said predetermined distance from said first pivot means whereby digital movement of said button end portion along its normal arcuate path from its centered position causes greater movement of said second end of said movable contact means toward engagement with one of said plurality of fixed contact means to provide a short actuating movement switch.

19. The switch set forth in claim 18 wherein said button end portion is particularly formed and arranged for receipt of the human thumb, arcuate movement of said button end portion less than 8° from the said centered position on the longitudinal axis in any of a plurality of directions being operable to cause engagement of said second end of said movable contact means with different said fixed contact means, whereby short movements of the human thumb without movement of the remainder of the human hand can produce rapid switching action.

* * * * *